US008231199B2

(12) United States Patent
Hendricks et al.

(10) Patent No.: US 8,231,199 B2
(45) Date of Patent: Jul. 31, 2012

(54) ORIFICE HEALTH DETECTION DEVICE AND METHOD

(75) Inventors: Jeffrey T. Hendricks, Camas, WA (US); Alexander Govyadinov, Corvallis, OR (US); Prodpran Suetrong, Bangkok (TH)

(73) Assignee: Hewlett-Packard Development Company, L.P., Houston, TX (US)

( * ) Notice: Subject to any disclaimer, the term of this patent is extended or adjusted under 35 U.S.C. 154(b) by 342 days.

(21) Appl. No.: 12/454,898

(22) Filed: May 26, 2009

(65) Prior Publication Data

US 2009/0244151 A1 Oct. 1, 2009

Related U.S. Application Data

(63) Continuation-in-part of application No. 12/079,338, filed on Mar. 25, 2008.

(51) Int. Cl.
*B41J 2/165* (2006.01)

(52) U.S. Cl. ..... 347/29; 347/19

(58) Field of Classification Search ..... 347/19, 347/29, 81
See application file for complete search history.

(56) References Cited

U.S. PATENT DOCUMENTS

| | | | | |
|---|---|---|---|---|
| 5,581,284 | A * | 12/1996 | Hermanson | 347/43 |
| 5,621,524 | A | 4/1997 | Mitani | |
| 6,517,184 | B1 | 2/2003 | Bruch | |
| 6,565,179 | B1 | 5/2003 | Bruch | |
| 6,616,261 | B2 * | 9/2003 | Adkins et al. | 347/19 |
| 6,648,444 | B2 | 11/2003 | Valero | |
| 6,769,756 | B2 | 8/2004 | Su | |
| 6,814,422 | B2 | 11/2004 | Bruch | |
| 6,877,838 | B2 * | 4/2005 | Elgee | 347/40 |
| 6,935,717 | B2 | 8/2005 | Su | |
| 6,969,159 | B2 | 11/2005 | Su | |
| 7,287,824 | B2 | 10/2007 | Subirada | |
| 7,434,919 | B2 | 10/2008 | Hawkins | |
| 7,442,180 | B2 | 10/2008 | Vitello | |

* cited by examiner

*Primary Examiner* — Lamson Nguyen

(57) ABSTRACT

A method of detecting orifice health includes moving a cap support into a drop detect position wherein a light source mounted on the cap support is positioned adjacent an array of fluid ejecting orifices, from the light source, projecting a light beam adjacent to the array of fluid ejecting orifices, ejecting at least one fluid drop from the array and through the light beam, and detecting scattered light from the at least one ejected fluid drop.

24 Claims, 2 Drawing Sheets

ORIFICE HEALTH DETECTION DEVICE AND METHOD

This application is a continuation in part of U.S. patent application Ser. No. 12/079,338, filed on Mar. 25, 2008, entitled A DROP DETECTION MECHANISM AND METHOD OF USE THEREOF, and hereby incorporated by reference herein.

BACKGROUND

Printing devices, such as thermal ink jet printers, may include orifice plates including multiple orifices therein. A determination of orifice health, i.e., if an individual orifice is occluded, and if so, to what extent, and whether or not the ejection device of the individual orifice is functioning, may be periodically determined so as to schedule orifice plate maintenance and/or to compensate for the occluded orifice by use of another orifice during printing. Testing individual ones of the multiple orifices sequentially may be time consuming and may utilize expensive equipment.

DETAILED DESCRIPTION OF THE DRAWINGS

Figure 1:
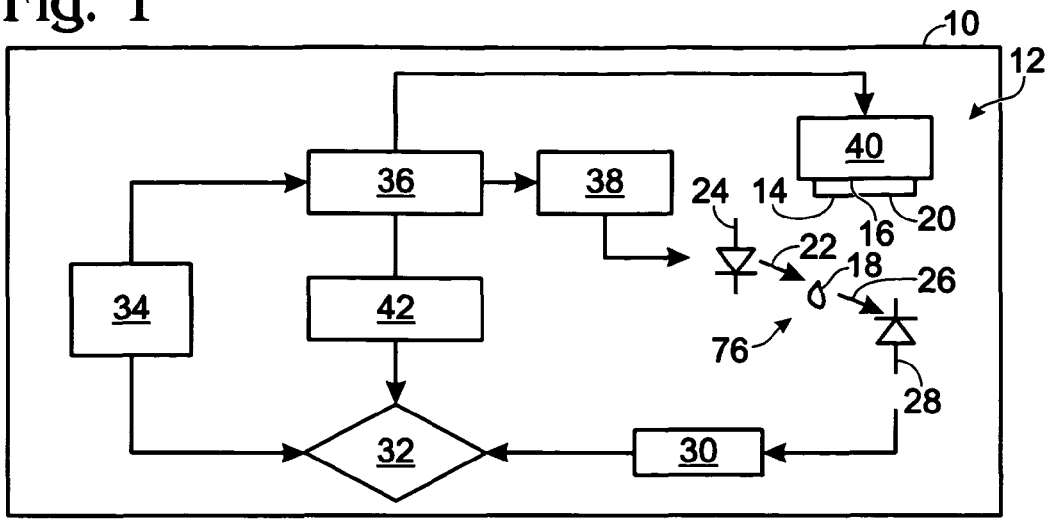
FIG. 1 is a block diagram showing example components of an example print device including an example orifice health detection device.
Figure 2:
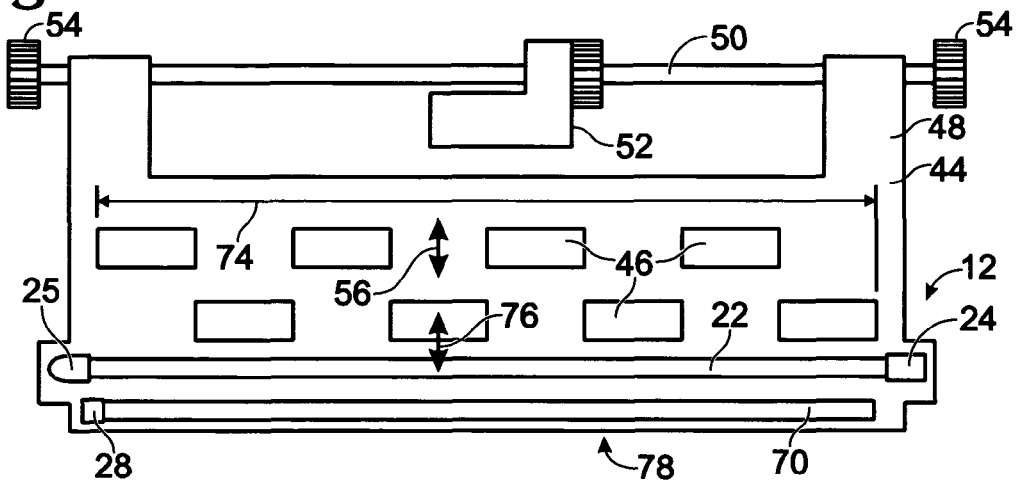
FIG. 2 is a schematic top view of an example embodiment of a printing device including an example embodiment of components of an orifice health detection device.

FIG. 1 is a block diagram showing example components of a print device 10 including an example orifice health detection device 12. An ink ejection array 14, including an orifice plate 16, ejects one or more fluid droplets 18, such as ink droplets, from individual orifices 20 through light beam 22, wherein light beam 22 is generated by light source 24 and is stopped by a light stopper 25 (FIG. 2). The scattered light 26 from droplet 18 is detected by light detector 28 and the signal is converted to an electrical signal and transmitted to an amplifier 30. The signal from amplifier 30 is transmitted to a comparator 32 which transmits the light scattering information to a central processing unit (CPU) 34, such as a computer. Computer 34 then uses this information to control an ink jet controller 36 which in turn controls a light source driver 38 and printhead 40. The ink jet controller 36 may conduct a delay calculation 42 that is transmitted to comparator 32 wherein this information may be utilized by computer 34 to determine the health of individual orifices 20 of printhead 40.

FIG. 2 is a schematic top view of an example embodiment of a printing device 10 including an example embodiment of components of an orifice health detection device 12. In this embodiment, detection device 12 is mounted on a cap structure 44 including a plurality of caps 46 that may be utilized to cap orifices plates 16 (FIG. 1) when the orifice plates 16 are not in use, such as during times of non-printing. Orifice health detection device 12 may include light source 24, which may produce light beam 22, which may be stopped by light stopper 25. Scattered light 26 may be collected by light guide 70 which may transmit the scattered light 26 to light detector 28. Cap structure 44 may include a cap sled 48 including a cap rod 50 extending therethrough. A motor 52 may be mounted on cap rod 50 and configured to rotate cap rod 50, along with gears 54 secured to the ends of cap rod 50. By rotating cap rod 50 and gears 54, which may engage mating gears on a printing device housing (not shown), motor 52 may function to move cap structure 44 within print device 10 and along a cap sled path 56. In this manner, motor 52 may move caps 46 into a capping position on orifice plates 16 when ink is not being ejected from orifices 20 of orifice plates 16. Moreover, motor 52 may also be utilized to move cap sled 48 into a drop detection position (see FIGS. 3A and 3B) below orifice plates 16 so as to detect a health of orifices 20 of the orifice plates 16.

The positioning of drop detection device 12 on cap structure 44 has many advantages. For example, use of cap motor 52 to move detection device 12 into a detection position (see FIGS. 3A and 3B) may reduce the manufacturing cost and the size of print device 10 because a single motor may be utilized to perform multiple functions. Moreover, placement of drop detection device 12 on cap structure 44, which may be moved away from orifices 20 during printing, may position drop detection device 12 away from aerosol particles during printing, which may increase the life of the drop detection device 12. Furthermore, placement of drop detection device 12 on cap structure 44 may reduce the size of print device 10 because a separate support structure may not be utilized for supporting the drop detection device 12, and may allow detection device 12 to be placed within a relatively small sized area of print device 10.

Figure 3A:
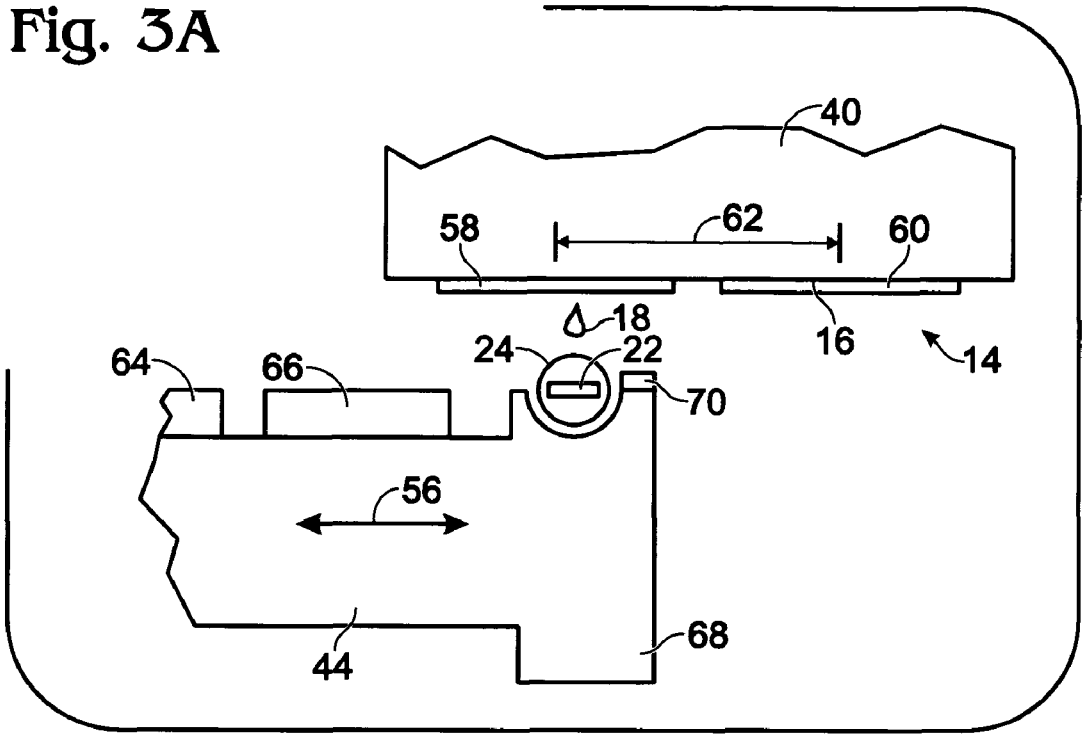
FIGS. 3A-3B are schematic side views of an example embodiment of a printing device including an example embodiment of components of an orifice health detection device moved between two rows of die on a printhead.
Figure 3B:
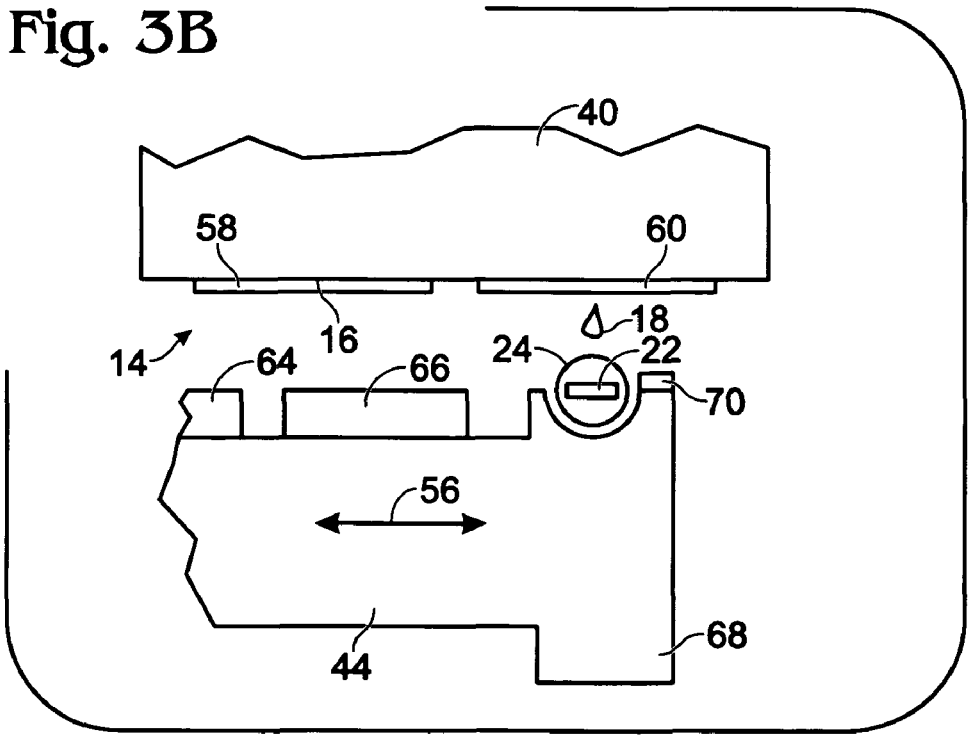

FIGS. 3A-3B are schematic side views of an example embodiment of a printing device 10 including an example embodiment of components of an orifice health detection device 12 moved between a first row of die 58 and a second row of die 60 of orifice plate 16 on a printhead 40. First row 58 and second row 60 of the die may be offset from one another by a distance 62, wherein distance 62 may be in a range of zero to twenty millimeters, and may be approximately one to three millimeters (1-3 mm), for example. In other examples, any distance 62 may be utilized. Distance 62 may be measured parallel to cap sled path 56. During capping, a first row 64 of caps 46 may be aligned with and moved into capping engagement with first row of die 58 and second row 66 of caps 46 may be aligned with and moved into capping engagement with second row of die 60, by operation of motor 52.

Similarly, during drop detection of drops 18 from first and second rows of die 58 and 60, respectively, light source 24 and light beam 22 may be aligned with first row of die 58 and second row of die 60, respectively, by movement of cap structure 44 by motor 52. In particular, motor 52 may move cap sled 48 into a first drop detection position (FIG. 3A) such that light beam 22 produced by light source 24 is positioned below first row of die 58. (In the figure as shown, light beam 22 is shown small for ease of illustration but in use may be of a size sufficient to illuminate all drops ejected from orifice plate 16 across a width of the orifice plate). Computer 34 may then activate printhead 40 to eject a drop or drops 18 from ones of individual orifices 20 of first row of die 58. Each of the drops 18 will pass through light beam 22 while falling to an ink repository 68 on cap sled 48, the ink repository 68 positioned below light beam 22. As the drop or droplets 18 pass through light beam 22, light is scattered from the drops 18 and the scattered light 26 (see FIG. 4) is collected in a light guide 70, which may be positioned adjacent light beam 22. Light guide 70 may transmit the scattered light 26 to light detector 28 (FIG. 1) and thereafter computer 34 may conduct a determination of orifice health of each of the individual orifices 20 of first row of die 58. After a health of the orifices 20 of first row of die 58 has been calculated, motor 52 may move cap sled 48 into a second drop detection position (FIG. 3B) so that computer 34 may conduct a determination of orifice health of the orifices 20 of second row of die 60. In another embodiment, cap sled 48 may be moved slowly and continuously beneath first and second rows of die 58 and 60, along cap sled path 56, as computer 34 conducts a determination of orifice health of the orifices 20 of both rows of die 58 and 60.

Figure 4:
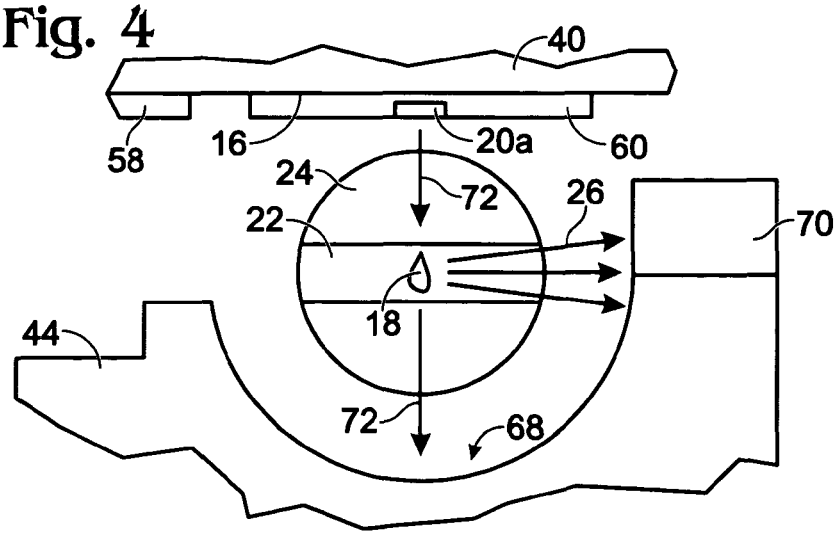
FIG. 4 is a schematic detailed side view of an example embodiment of an orifice health detection device showing light scattering by an ink drop.

FIG. 4 is a schematic detailed side view of an example embodiment of an orifice health detection device 12 showing light scattering by an ink drop 18. As droplet 18 is ejected from a particular orifice 20*a*, the droplet 18 follows a droplet path 72 downwardly toward ink repository 68 within cap structure 44. As droplet 18 falls along droplet path 72, the droplet 18 passes through light beam 22 produced by light source 24. The droplet 18 will scatter light from light beam 22 to produce scattered light 26 that may be projected to light guide 70. Light guide 70 may be a light tube, a reflector, or any other structure for passing scattered light to light detector 28 (FIG. 1). Light guide 70 may transmit the scattered light 26 to light detector 28 (FIG. 1) so as to detect the health of orifice 20*a*, namely, whether or not orifice 20*a* is occluded, and if so, to what extent, and/or whether or not the firing mechanism of the particular orifice 20*a* is functioning. The detection of the health of individual ones of orifices 20 may be conducted simultaneously for multiple orifices or sequentially for each of the multiple orifices. After assessing the health of individual orifices 20 of printhead 40, cap structure 44 may be moved from beneath printhead 40 and printing may be conducted on a sheet of print media (not shown), for example. Accordingly, cap motor 52 may be utilized to move both the caps 46 and the drop detection device 12 into position, providing a cost effective and space efficient design.

Referring again to FIGS. 2 and 3A-3B, in one embodiment, first and second rows 58 and 60 of die together may extend across a width 74 of a print media path 76 of print zone 78, wherein print media path 76 and cap sled path 56 may be parallel to one another. Accordingly, array 14 may be referred to as a page wide array. In one embodiment, orifice plate 16 may not be moved in a direction parallel to width 74 as which may be the case in a printer including a movable carriage mounted printhead carriage rod. Accordingly, in the embodiment shown, array 14 may also be referred to as a fixed or a stationary printing array 14 because orifice plate 16 may remain stationary in its position with respect to print media path 76 and along width 74.

Page wide arrays differ from traditional movable print carriage printing systems. In particular, page wide arrays may not provide for manifold nozzle redundancy of scanning printing head engines, i.e., each nozzle 20 of a page wide array may be the sole ink printing orifice for a particular region of a page and, therefore, print quality may be degraded by occlusion of a single orifice 20. Print quality may be enhanced by a precise knowledge of the health of each nozzle 20 before starting printing of an image. Knowledge of an occluded or otherwise unhealthy print nozzle orifice in a page wide array may enable the writing system of the printer to apply a limited nozzle substitution so as to provide a high quality printed image.

Page wide array products may not be easily available in consumer and commercial printing markets because of the high complexity and stringent specifications of the writing system to support a high quality, ink printing page wide array that includes a nozzle health drop detector. However, because of the potential high productivity of such page wide arrays, the low noise generated by such page wide arrays, and the small form factors of page wide arrays, it may be desirable to provide a low cost page wide array printer for all printing market segments from consumer/office printers to digital presses. Providing a low cost page wide array printer may be feasible if a low cost drop detection device can be formulated for use in a page wide array printer.

Use of drop detectors has not heretofore been utilized in page wide printing arrays because of lack of experience, high complexity, high cost, and difficulties of scalability, i.e., providing a drop detector for the entire page wide array. Typically, drop detectors developed for traditional small and scanning printers are not scalable to page wide arrays because traditional drop detectors do not have a wide angle field of view. In particular, if the detector utilized is an electrostatic detector, such a page wide electrostatic detector would have a prohibitively large cost because of the noble metal coatings used on the detector. Moreover, if an electrostatic detector is utilized in a page wide array, such a detector would have an increased electrode area and would correspondingly increase the noise floor detection system utilized. Moreover, such large electrostatic detectors would not function reliably and therefore would be useless for page wide array applications. Accordingly, classical scanning drop detectors used in upscaled products are not reliable, are very slow, and do not meet the expectations of cost and performance. In other words, a page wide array electrostatic drop detector would have a huge footprint, which is a challenge for traditionally functioning electrostatic drop detectors.

In contrast, the light scattering optical system of the present invention is very scalable, and as no moving parts for the optical detector which renders the detector more reliable, which is important for large page wide array printers. Additionally, light guides 70 utilized in the light scattering optical system of the present invention are scalable for page wide arrays with little cost increase.

In printers including page wide arrays 14, each of the individual orifices 20 may be solely responsible for printing ink within its own individual region within width 74 of print-zone 78. Accordingly, if a particular orifice 20*a*, also referred to as a nozzle, is fully or even partially occluded, the finished printed product may include an unprinted line extending along a length of the printed print media in a line parallel to the position of orifice 20*a*, for example. Accordingly, determining the health of each of the individual orifices 20 of array 14, i.e., whether or not the individual orifice 20 is occluded and if so to what extent, and if the ink ejection mechanism of the individual orifice is functioning, in such page wide arrays 14 may allow corrective measures to be taken to reduce or eliminate unprinted regions in the finished printed product. For example, if a particular orifice 20*a* is found by the printing orifice health detection device 12 to be occluded or the ejection device for the particular orifice is not functioning, servicing of the array 14 may be conducted, or adjacent orifices may be activated to eject ink therefrom to compensate for the non-functioning orifice.

Scattered light 26 may be directed as scattered light directly toward a light detection device 28, or as scattered light toward a light guide device 70, which is then projected to light detection device 28 by light guide device 70. Light guide device 70 may be a light pipe or a reflector, such as a mirror. Light detection device 28 may be a contact image sensor (CIS), which in one embodiment may be a complementary metal oxide semiconductor (CMOS) line array, or may be a photo diode. A predetermined low threshold light intensity may indicate the presence of an ink drop 18 and a predetermined high threshold light intensity may indicate the absence of an ink drop 18. In the embodiment shown in FIG. 1, light detection device 28 is positioned opposite array 14 from light source 24, and light guide device 70 is positioned parallel to light beam 22.

In other embodiments, other shapes, locations, angles, and the like of the components, or other components, of the system may be utilized for the determination of orifice health.

Other variations and modifications of the concepts described herein may be utilized and fall within the scope of the claims below.

We claim:

1. An orifice health detection device, comprising:

an array of fluid ejecting orifices, each of said fluid ejecting orifices configured to eject at least one fluid drop;

a light source that produces a light beam configured to scatter light from said at least one ejected fluid drop;

a light detector configured to detect scattered light from said at least one ejected fluid drop;

a cap structure adapted for capping said fluid ejecting orifices, wherein said light source and said light detector are mounted on said cap structure; and a light guide positioned adjacent to said light beam, said light guide configured to direct said scattered light to said light detector, wherein said light guide is chosen from the group consisting of a light pipe and a reflective device, wherein the cap structure comprises a plurality of caps spaced along a first axis and wherein the light guide continuously extends along a second axis parallel to the first axis opposite to each of the plurality of caps.

2. The device of claim 1 wherein said array is a page wide array.

3. The device of claim 2 further comprising a motor connected to said cap structure and adapted for moving said cap structure, and said light source and said light detector mounted thereon, with respect to said array.

4. The device of claim 3 wherein said array is positioned above a print media path, and wherein said motor is adapted for moving said light source and said light detector in a direction parallel to said print media path.

5. The device of claim 2 wherein said cap structure includes a fluid repository, and wherein said light beam is projected over said fluid repository such that a fluid drop ejected by said array and into said repository passes through said light beam.

6. The device of claim 1 wherein said light source includes at least one laser light source.

7. The device of claim 1 wherein said light detector is chosen from the group consisting of a contact image sensor and a photodiode.

8. The device of claim 1 wherein said array comprises a plurality of die extending across a width of a printzone.

9. The device of claim 1 further comprising a controller that receives light scattering information detected by said light detector, said controller utilizing said light scattering information to determine a health of an orifice that ejected said at least one ejected fluid drop.

10. The device of claim 1, wherein the light source is configured to direct the light in a first direction and wherein the light guide is configured to receive the scattered light that is extending in a second direction perpendicular to the first direction.

11. The device of claim 1, wherein the light source is configured to produce a light beam that continuously extends along a third axis parallel to the first axis opposite to each of the plurality of caps.

12. The device of claim 1, wherein the light beam continuously extends along a third axis parallel to the first axis opposite to each of the plurality of caps.

13. A method of manufacturing a drop detection device, comprising:

providing an array of fluid ejecting orifices, said fluid ejecting orifices configured to eject at least one fluid drop;

providing a cap structure adapted for capping said array, said cap structure including a light source and a light detector positioned thereon;

said light source adapted to produce a light beam extending in a first direction, the light beam being configured to scatter light from said at least one ejected fluid drop;

positioning a light guide on said cap structure, the light guide being configured to receive scattered light from the at least one ejected drop, the scattered light being received extending in a second direction perpendicular to the first direction, the light guide configured to direct said scattered light to said light detector; and said light detector adapted to detect scattered light from said at least one ejected fluid drop.

14. The method of claim 13 further comprising connecting a controller to said light detector, said controller configured to determine a health of an orifice that ejected said at least one ejected fluid drop based on said detected scattered light.

15. The method of claim 13 further comprising connecting a motor to said cap structure, said motor adapted for moving said cap structure into a capping position on said array and into a light detection position adjacent said array.

16. The method of claim 13, wherein the cap structure comprises a plurality of caps spaced along a first axis and wherein the light guide continuously extends along a second axis parallel to the first axis opposite to each of the plurality of caps.

17. The method of claim 16, wherein the light source is configured to produce a light beam that continuously extends along a third axis parallel to the first axis opposite to each of the plurality of caps.

18. The method of claim 13, wherein the cap structure comprises a plurality of caps spaced along a first axis and wherein the light beam continuously extends along a second axis parallel to the first axis opposite to each of the plurality of caps.

19. An orifice health detection device comprising:

an array of fluid ejecting orifices, each of said fluid ejecting orifices configured to eject at least one fluid drop;

a light source that produces a light beam extending in a first direction, the light beam being configured to scatter light from said at least one ejected fluid drop;

a light detector configured to detect scattered light from said at least one ejected fluid drop; and a cap structure adapted for capping said fluid ejecting orifices, wherein said light source and said light detector are mounted on said cap structure; and a light guide positioned adjacent to said light beam, the light guide being configured to receive scattered light from the at least one ejected drop, the scattered light being received extending in a second direction perpendicular to the first direction, the light guide configured to direct said scattered light to said light detector.

20. The device of claim 19, wherein the cap structure comprises a plurality of caps spaced along a first axis and wherein the light guide continuously extends along a second axis parallel to the first axis opposite to each of the plurality of caps.

21. The device of claim 20, wherein the light source is configured to produce a light beam that continuously extends along a third axis parallel to the first axis opposite to each of the plurality of caps.

22. The device of claim 19, wherein the cap structure comprises a plurality of caps spaced along a first axis and wherein the light beam continuously extends along a second axis parallel to the first axis opposite to each of the plurality of caps.

23. The device of claim 19, wherein the scattered light is from the at least one ejected fluid drop while the at least one ejected fluid drop is in flight.

24. An orifice health detection device, comprising:

an array of fluid ejecting orifices, each of said fluid ejecting orifices configured to eject at least one fluid drop;

a light source that produces a light beam configured to scatter light from said at least one ejected fluid drop;

a light detector configured to detect scattered light from said at least one ejected fluid drop;

a cap structure adapted for capping said fluid ejecting orifices, wherein said light source and said light detector are mounted on said cap structure; and a light guide positioned adjacent to said light beam, said light guide configured to direct said scattered light to said light detector, wherein said light guide is chosen from the group consisting of a light pipe and a reflective device, wherein the cap structure comprises a plurality of caps spaced along a first axis and wherein the light beam continuously extends along a second third axis parallel to the first axis opposite to each of the plurality of caps.

* * * * *